US006877283B2

(12) United States Patent
Yoshiwara et al.

(10) Patent No.: US 6,877,283 B2
(45) Date of Patent: Apr. 12, 2005

(54) MANUFACTURE AND USE OF EARTHQUAKE RESISTANT CONSTRUCTION BLOCKS

(76) Inventors: Susumu Yoshiwara, 1185-44 Shimotaniguchi, Ijuin-cho, Hioki-gun, Kagoshima-ken (JP); Eisei Nigeme, 530-1 Miwamachi, Machida-shi, Tokyo (JP)

( * ) Notice: Subject to any disclaimer, the term of this patent is extended or adjusted under 35 U.S.C. 154(b) by 347 days.

(21) Appl. No.: 09/818,851

(22) Filed: Mar. 28, 2001

(65) Prior Publication Data

US 2002/0014043 A1 Feb. 7, 2002

(30) Foreign Application Priority Data

Mar. 28, 2000 (JP) ..... 2000-132973
Nov. 6, 2000 (JP) ..... 2000-11

(51) Int. Cl.[7] ..... E04B 1/32

(52) U.S. Cl. ..... 52/89; 52/600; 52/604; 52/568; 264/275

(58) Field of Search ..... 52/89, 426, 600, 52/601, 604, 606, 608, 562, 565, 568; 106/738, 819; 264/263, 275, 279, 333

(56) References Cited

U.S. PATENT DOCUMENTS

| | | | | | |
|---|---|---|---|---|---|
| 129,479 | A | * | 7/1872 | Johnson | 52/89 |
| 180,028 | A | * | 7/1876 | Holley | 122/6 R |
| 464,562 | A | * | 12/1891 | Guastavino | 264/71 |
| 591,949 | A | | 10/1897 | Cheney | |
| 801,361 | A | | 10/1905 | Clayton et al. | |
| 918,366 | A | | 4/1909 | Quereau | |
| 954,410 | A | | 4/1910 | Gossett | |
| 984,878 | A | | 2/1911 | Aylett | |
| 1,123,874 | A | * | 1/1915 | Hemmer | 52/379 |
| 1,476,995 | A | * | 12/1923 | Miller | 52/642 |
| 1,487,578 | A | | 3/1924 | Kirkpatrick | |
| 1,534,353 | A | | 4/1925 | Besser | |
| 1,971,051 | A | | 8/1934 | Reiner et al. | |
| 2,250,175 | A | | 7/1941 | Blaski | |
| 2,645,115 | A | | 7/1953 | Abeles | |
| 2,696,729 | A | | 12/1954 | Vander Heyden | |
| 3,559,361 | A | | 2/1971 | Sarros | |
| 3,616,108 | A | * | 10/1971 | Whitehouse | 161/36 |
| 4,442,149 | A | | 4/1984 | Bennet | |
| 4,915,888 | A | * | 4/1990 | Sato | 264/71 |
| 4,995,932 | A | * | 2/1991 | Yoshida et al. | 264/71 |
| 5,168,008 | A | * | 12/1992 | Yoshida et al. | 428/295 |
| 5,624,615 | A | * | 4/1997 | Sandorff | 264/71 |
| 5,637,236 | A | * | 6/1997 | Lowe | 216/39 |
| 5,820,299 | A | | 10/1998 | Anderson | |
| 5,992,119 | A | | 11/1999 | Rokhlin | |
| 6,230,409 | B1 | * | 5/2001 | Billings et al. | 29/897.32 |

* cited by examiner

*Primary Examiner*—Brian E. Glessner
(74) *Attorney, Agent, or Firm*—Clyde I. Coughenour

(57) ABSTRACT

Earthquake resistant blocks or discrete structures are manufactured using pieces of low quality construction materials such as slag, concrete waste, chipped stone, Sirasu, etc. The pieces are placed in a mold and arranged in the mold so that they are in intimate contact with the mold sides and with each other throughout the mold. Once positioned, mortar or other concrete binding material is poured in to retain the low quality construction materials in contact with each other. When the blocks or discrete structures are placed adjacent to each other, such as when constructing arches, they absorb or dissipate the shock and vibration energies by having the sides of the blocks, and in particular the low quality materials within the blocks, in firm frictional contact. The amount of concrete used is greatly reduced and local and normally scrap material can be used and recycled.

19 Claims, 6 Drawing Sheets

Construction Techniques Comparison

| | (1) note | (2) | (3) | Example |
|---|---|---|---|---|
| 1 | high quality material | continuous structure | non arch | General technique for pillar, beam, crossbeam, floor. |
| 2 | high quality material | continuous structure | arch | General technique for RC arch |
| 3 | high quality material | discrete structure | non arch | General technique for heaping stones and blocks |
| 4 | high quality material | discrete structure | arch | Traditional stone arch is not recognized as general technique in terms of economy. Economy and endurance will be pursued by the technique according to the present invention |
| 5 | low quality material | continuous structure | non arch | Unstable (not usable) |
| 6 | low quality material | continuous structure | arch | Used for the ceiling of a kiln for traditional charcoal making. Not recognized as a modern technique. Rational design and practice can be realized by the technique according to the present invention |
| 7 | low quality material | discrete structure | non arch | general technique for soil fort and mound |
| 8 | low quality material | discrete structure | arch | new technique |

Fig. 1

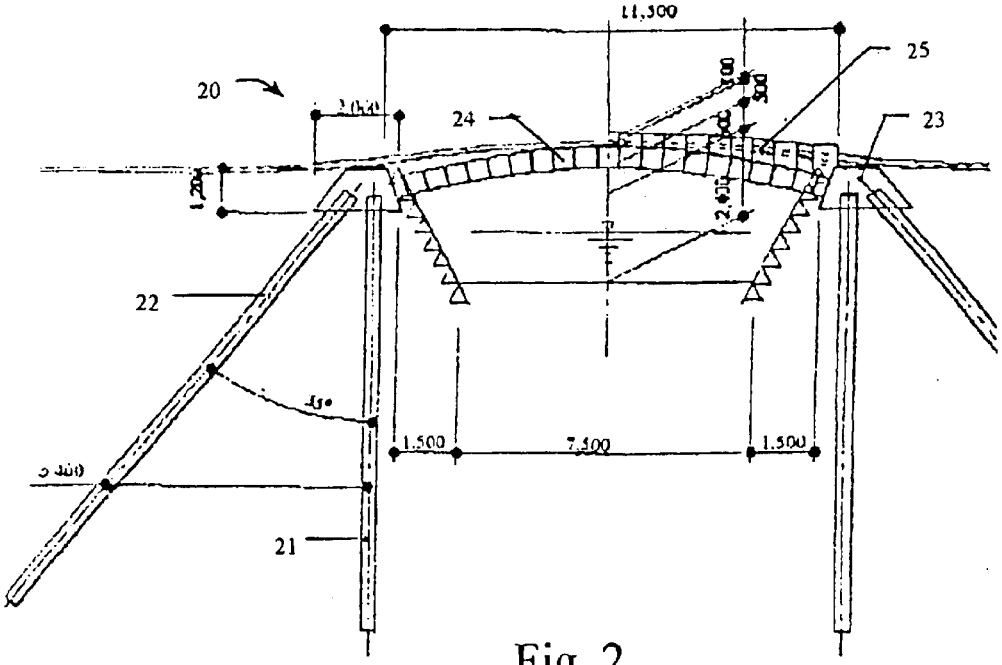

Fig. 2

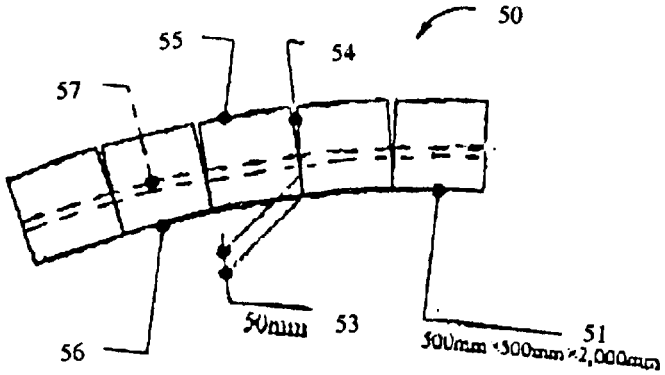

Fig. 5

Design condition

| | | |
|---|---|---|
| Bridge Type | | Road bridge (A live load) |
| Bridge length | | 11,500m |
| Bridge width | | 12,000m (useful width 11,000m) |
| Style of upper part | | constraint discrete material arch structure (stone arch) |
| Design model | | Individual elements analysis (normally, at live load, on earthquake in the bridge axis direction) and 3-D shell model (on earthquake in the direction orthogonal to the bridge axis direction) |
| Style of lower part and foundation | | Pit foundation ( oblique pit 35° ) |
| Shake | | Dynamic analysis |
| Material used | Arch | See the separate table. |
| | Prestress | To give the ability to restore separated meeting ends on abnormal load. |
| | Pavement | paving (curved stone paving) |
| | Pit | Pit φ400 |

Fig. 6

Construction job flowchart

MANUFACTURE AND USE OF EARTHQUAKE RESISTANT CONSTRUCTION BLOCKS

BACKGROUND OF THE INVENTION

1. Field of the Invention

Construction blocks are manufactured independently or in place for final use using materials generally considered to be discardable or of limited value. The stones and/or coarse aggregate material is placed in molds in intimate, abutting contact, then concrete, mortar or other binder is poured in to securely hold the material in place forming the block. Other strata of different composition and/or tubes and reinforcement can be included.

2. Description of Related Art

Conventionally, concrete is defined in terms of its specific materials, strength, and design. Concrete generally used as a structural component consists of cement with fine and/or coarse aggregates that have adjusted granule sizes.

The term "rich concrete" usually refers to a product of mixed cement and aggregate, that often includes an iron reinforcement. Among aggregates for "rich concrete," sea sand is used as a fine aggregate but earth and sand are becoming scarce in view of forestation and other conservation activities. The collection of sea sand has been forbidden in many places because of its limited reserves and significant adverse influence on the environment and deep sea ecosystems. Large scale mining for limestone, which is largely demanded as raw material for cement, results in changing mountain and landscape appearance. This mining results in ecological, scenic and energy consumption that does harm to the environment. It also leads to resource depletion and environmental pollution due to the spreading of industrial waste.

Conventional block or discrete structures include stone arch bridges. Although there are some structural similarities, traditional discrete techniques assume the use of high quality stones that are generally inordinately or excessively large in strength when designed. Design quality is dependent on the skill of stonemasons while the technique according to the present invention emphasizes sound design and reliable practice.

Stone arch bridges are conventionally not considered to be a modern construction technique although their arch, beauty and harmony with nature are well recognized. Among many, the following reasons are practically given for this:

(1) Stone bridges have low load-bearing capacity and are an old style used primarily for pedestrians;
(2) Only short spans are considered safe for stone bridges;
(3) Stone materials are not uniform and are considered vulnerable to earthquakes;
(4) Discrete structure does not provide for a quantitative evaluation for safety and unit stress;
(5) Appearance depends on the skill of traditional stonemasons, who are now very few; and
(6) Stone bridges require high construction cost.

The prior art technologies can be categorized by (1) whether low quality material can be used for main structural components or not, (2) whether it is a discrete structure or not, and (3) whether it is an arch or not. The technique using low quality materials is not recognized as a modern technique.

To date, it has been believed that discrete structures are vulnerable to earthquakes. This is because brick buildings were seriously damaged in Kanto's big earthquake. Since then, arch structures have been considered the same as brick buildings.

SUMMARY OF THE INVENTION

Conventional "rich concrete" structures are responsible for environmental problems such as spreading industrial wastes and the depletion of resources. Making use of low purity, low strength, recycled material is a great contribution to solving environmental problems.

Low quality materials are disposed of by using them in land fills, or as ballast for railway foundations, etc. It is desirable to recycle construction waste. However, recycled materials generally have limited use applications because of their reduced strength, quality and instability. Conventionally, they are not used for structural components. Making use of low purity and low strength materials, such as local soils Sirasu and Masa, slag, concrete waste, and chipped stone, that have reduced strength, is a great contribution to solving environmental problems.

The present invention relates to structures, primarily in the construction and architecture fields, that enable their use for main structural components using low quality materials that are conventionally not used for construction. This provides economical construction using environmentally friendly materials that produce a stable, attractive structure. Environmentally friendly refers to materials that are locally abundant, but not normally acceptable for construction, such as slag, which is discharged as industrial waste and has insufficient strength and unstable quality, and recycled material from construction waste. It has been found that these materials can be used as main structural components, and ensure the use or application of recycled material. Use of these materials leads to saving energy by reducing raw material mining and preserves the environment by reducing interference with natural scenery and ecosystems. The present structure has particular value where the space inside an arch is used, such as those that take advantage of light weight for mounting on a weak support surface, and those that do not use the deformation properties of a structure. The invention finds use for roofs, ceilings, bridges, tunnel linings, ditch covers, buildings, mounds, elevated structures, dams, slope protectors, etc., as well as for reinforcement and repair of existing structures. Bridges with short spans of up to 50 meters can be constructed without open spandrels. Open spandrels are wall stones and fillers used between arch stones and the bridge surface reducing body weight. They are open areas when seen from the side. The invention provides for initial construction and life cycle economy with an attractive appearance when compared to conventional steel and concrete bridges.

The technique according to the present invention forms a structure using blocks or constraint discrete material and arch action in order to avoid stress concentration caused by continuous material, such as poured concrete, and to increase earthquake resistant properties. As a substitute for stones and concrete, low quality materials, that have not been used because of their problematic strength, are used in construction, such as an arch forming material. Structural characteristics and stable conditions are described for designing precast block, prepacked block and prestress techniques can be practiced.

The resistance to earthquake damage is increased by forming discrete structures or individual blocks by placing stones and/or coarse aggregate pieces in a mold, arranging them so as to have intimate contact between the individual pieces of stone and/or aggregate then holding the stone and/or aggregate in place by pouring cement or mortar over it to secure the aggregate in position. Blocks can be formed with aggregate between stones or in layers by covering stones with a coarse aggregate layer secured in place using mortar or cement. The amount of cement is reduced. Reinforcing means can also be used.

BRIEF DESCRIPTION OF THE DRAWINGS

FIG. 1 is a chart showing a comparison of various arch construction techniques.

FIG. 2 depicts a vertical side view of an arch bridge.

FIG. 5 shows a detail view of an arch section

FIG. 6 is a chart listing details of the bridge in FIG. 4.

DESCRIPTION OF THE PREFERRED EMBODIMENTS

Figure 3:
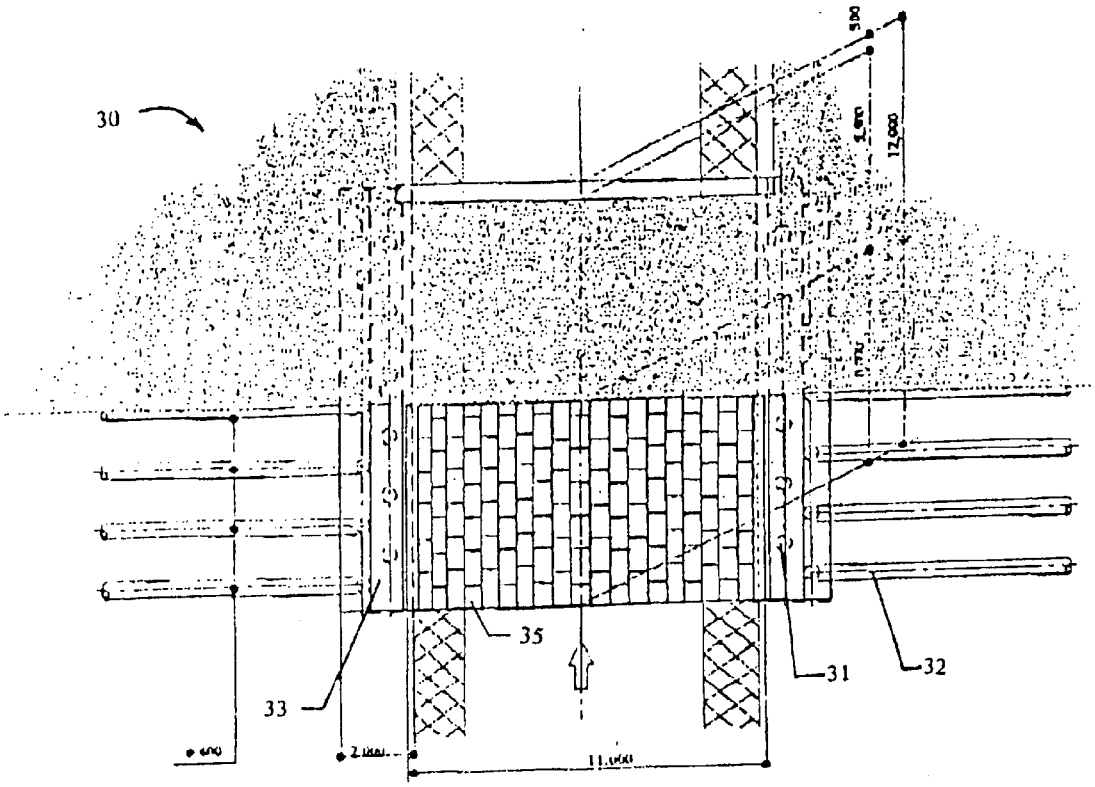
FIG. 3 depicts a top plan view of one end of a bridge.

Continuous material, such as poured concrete, is primarily used for construction work. Discrete preformed structures are not widely used and their use is often avoided. It has been found that due to the unusually large compression that cut stone blocks can withstand, materials that are routinely discarded or used for ballast or other non-construction purposes, because of their reduced strength, can be used to manufacture blocks or discrete structures that can be substituted for stones. Forming the blocks or discrete structure by packing the reduced strength material pieces into firm contact with each other, and using mortar to hold the pieces in contact, the blocks can be used in place of cut stones. It has now been found that these blocks have good resistance against earthquake damage due to their ability to absorb and dissipate vibration and shock energy.

The differences between the techniques are shown in FIG. 1 and the following discussion has reference to the chart of FIG. 1. Recently, a detailed test and study was conducted for the transport in section and restoration of the Nishida Bridge, Kagoshima. Through the comparison of load-bearing test results with individual factor analysis, it was quantitatively verified that (1) to (3) of FIG. 1 were derived from misunderstandings, it was also confirmed that unit stress can be quantitatively examined for safety reasons using computer simulation.

Our study confirms the reasons for not using stone arch bridges, as shown in FIG. 1 Examples 1 through 3, are the result of misunderstandings. For instance, for load-bearing capacity in (1), stone materials show high strength in compression and tolerated war tanks passing on them during World War II. For spans in (2), a 90 m span was constructed before World War II and a 120 m span was constructed with new, advanced techniques. For earthquake resistance in (3), it was reported that among the 675 bridges administrated by the metropolitan city of Tokyo, 164 were stone bridges and that only 7 of these were damaged while a total of 358 bridges were damaged by Kanto's big earthquake. This indicates that stone bridges are not particularly vulnerable to earthquakes when compared to other structural designs. Japan Roads History, Technical Section, Chapter 5: Bridges, p972, Japan Roads Association S.52.10.

Most recently, it was reported that approximately 100 brick arch bridges along the Osaka-Kobe and Kyoto-Osaka railways built in the Meiji period survived the Hanshin-Awaji earthquake, although many other constructed structures were damaged. Shigeru Onoda "Bricks and stone structures of Osaka-Kobe and Kyoto-Osaka railways and their characteristics," Civil Engineering History Study No. 20, p259, Civil Engineering Association 2000. In addition, the stone bridge report from the Sakura-jima volcano eruption and earthquake of 1904 and some foreign examples show that stone arch bridges are strong enough to resist earthquake damage.

Unit stress of stone bridges addressed in (4) is not known to have been studied and remains unknown. High construction cost in (6) mainly results from the price of stones used as arching material. Compared to conventional, prestressed concrete (PC concrete) structures several tens of percents are added. These result from mining, shaping and meeting end processing that are domestically done, and they are nearly the same cost as when processed stone material is imported from China.

A detailed study was also conducted on traditional stone bridge construction techniques. Although the sound and great technical skill used in their construction was impressive, it was predicted that modern mechanized practices would be applicable independent of the skill of the stonemasons. Following this, modern arch stone arrangement techniques including precast block, prepacked block and prestress techniques, were reviewed.

Appropriate block size molds are selected or constructed. The stones and/or aggregate waste are poured or placed within the mold and arranged so that the aggregate pieces are in firm, intimate contact with each other and with the sides of the mold. The stones and aggregate generally range from 50 to 60 cm in circumference for large, to about 20 to 40 cm for medium and about 5 to 10 cm for small pieces. Base concrete comprises extremely less cement with Sirasu or slag used in place of aggregate, resulting in the lower strength blocks that can be used by this invention. When the pieces are appropriately positioned, mortar is poured into the mold as a means for holding the aggregate pieces in position.

The stone and/or aggregate material that is packed, at least into the mold lower extremity, so that there is a direct, firm contact between the individual aggregate members, is held in position by mortar. When removed from the mold forms, an independent block is obtained. In this discrete structure, resulting from the technique of the present invention, the joining or abutting surfaces of the blocks have a large frictional force between them at the areas of contact. The forces placed on the blocks or discrete structures are thus propagated through direct contact between the aggregate materials between and within the blocks. This results in earthquake resistance because of the ability of the materials used to absorb energy without fracturing. The mortar serves only to keep the aggregate materials in place. Therefore the strength of the mortar is not as critical as it is in the standard concrete pouring process where the concrete materials are randomly dispersed or mixed together and cured and fixed in the mixed configuration. A variety of stone arch arrangements can be used, including lateral row ring, nib ring and mixed ring.

The upper or outer surfaces used for press fitting blocks together are monitored and controlled so that they are not perfectly flat in order to provide high friction between blocks mating surfaces.

The technique according to the present invention is a practical means used in the field to solve the problems described above taking into consideration economical benefit, safety and stability.

The unit stress applied to an arch member is determined by the magnitude of the axial directed force and thickness of the member. Conventional measuring methods are based on the experience gained with stone arch bridges. They are inordinately designed except for very thin rings and very flat rings. For the Nishida Bridge, Kogoshima, it was presumed that the allowable unit stress of the stone was 100 kfg/cm2, the maximum unit stress by self-weight was 8.0 kfg/cm2, and the maximum unit stress by active load was 3.0 kgf/cm2. The authors reported the details to the Civil Engineering Association in Yoshiwara, Nogame, et al., "Load bearing test and structural characteristics of stone arch bridges," Civil Engineering History Study No. 16 p.263, Civil Engineering Association 1996 and Yoshiwara, Nogame, et al., "Study on structural characteristics of stone arch bridges using individual factor analysis," Civil Engineering History Study No. 16 p281, Civil Engineering Association 1996. This shows that designing an arch according to the material strength enables the use of low strength materials. The authors reported that computer simulation results of bridges' behavior on earthquake and foundation displacement confirmed that they have excellent earthquake resistance and strain follow-up. These properties are seen to be consistent with the examples above.

An applied analysis showed that the required strength for arch material is not necessarily given for stone blocks. This allows the use of chipped stone, set slag material, and set concrete waste for arch material without the need for reinforced concrete. Accordingly, initial construction cost can be lowered and the design structure does not require much maintenance. Life expectancy cost can be dramatically lowered.

The technique according to the present invention gives acceptable appearance, environmental adaptability and resolves energy wasting procedures and resource depletion problems by using recycling techniques. In addition, the structures provide good load bearing, endurance, earthquake resistance, in an economical manner. The materials that make up the wall surfaces, fillings, bridge surfaces, etc., play an important role when constructing an arch. Conventional construction techniques can be satisfactorily applied using low quality materials to provide acceptable structures.

A supporting structure can be used for building conventional concrete arches. The structure of the support must be made so that it can be easily cut out and removed after the arch construction is completed. After the supporting structure is erected, the blocks for the arch are arranged on the support. The arrangement of the blocks must satisfy the stability requirements for a solid discrete structure in both the arch axis direction and the orthogonal direction. The technique of the invention satisfies these requirements.

Discrete constraint material is used to increase the earthquake resistance and to prevent disintegration due to stress concentrations that exist in continuous materials. This is accomplished by arch action in more than one direction using low quality materials. Discontinuous material discrete blocks are intentionally designed so their ends, and members inserted between them, absorb vibration energy, thereby increasing earthquake resistance. All or a portion of the end faces of the blocks engage each other. Stability is obtained by the constraint discrete structure, not by the overall integrity of the structure.

FIG. 2 shows a side view of an arch bridge 20. The arch is formed of blocks 24 supported at their ends with anchors 23. The anchors are positioned by vertical piles 21 and oblique piles 22. The road surface is shown as a stone paving 25. The piles absorb oblique forces on the arch or bridge.

FIG. 3 shows a top view of one end of a bridge 30. Shown among other things are vertical piles 31, oblique piles 32, anchor means 33 and stone paving 35.

Figure 4:
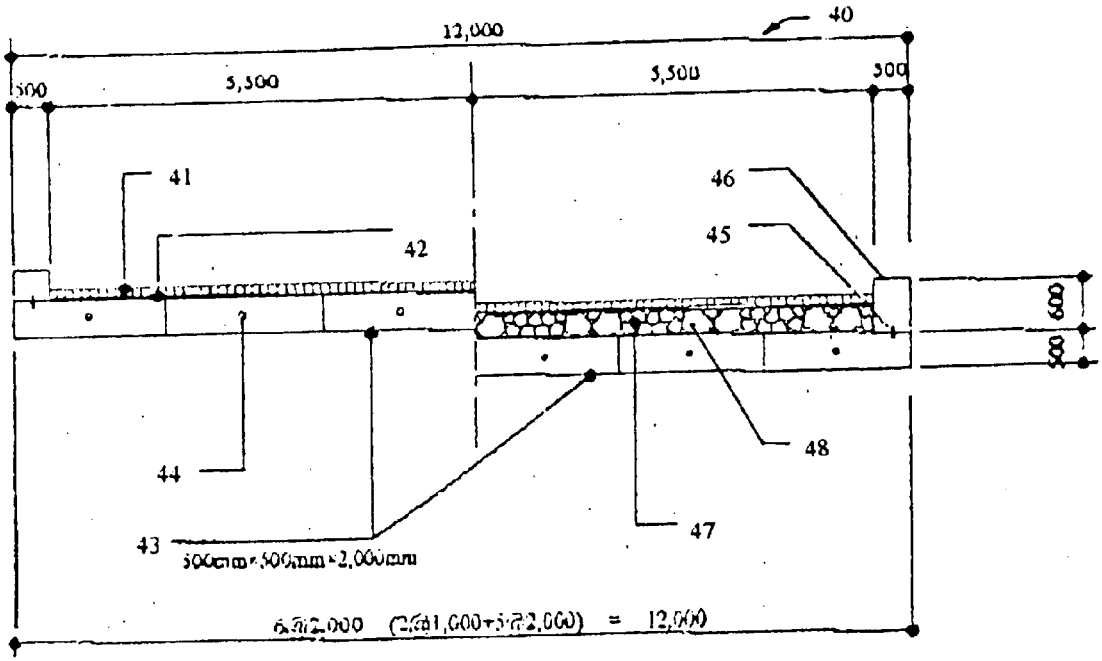
FIG. 4 is a cross-sectional view of a bridge.

FIG. 4 is a sectional view of a bridge 40. The bridge includes curved stone paving 41 over a mortar layer 42 over arch blocks 43 that are provided with prestress elements 44. The ends of the bridge include anchor means 45 and wall stones 46. The stones and/or aggregate 48 of the arch blocks have a filler 47.

FIG. 5 shows a detailed view of an arch section. The arch 50 is made up of parallelepiped arch blocks 51 with the lower intrados 56 sides abutting each other in an area 53 while the upper extrados 55 sides of the blocks form a non-abutting wedge-shaped area filled with concrete 54. The blocks are provided with a prestress accommodating aperture 57 for iron or steel rods.

FIG. 6 is a chart providing the dimensions and details of the bridge shown in FIG. 4.

Figure 8:
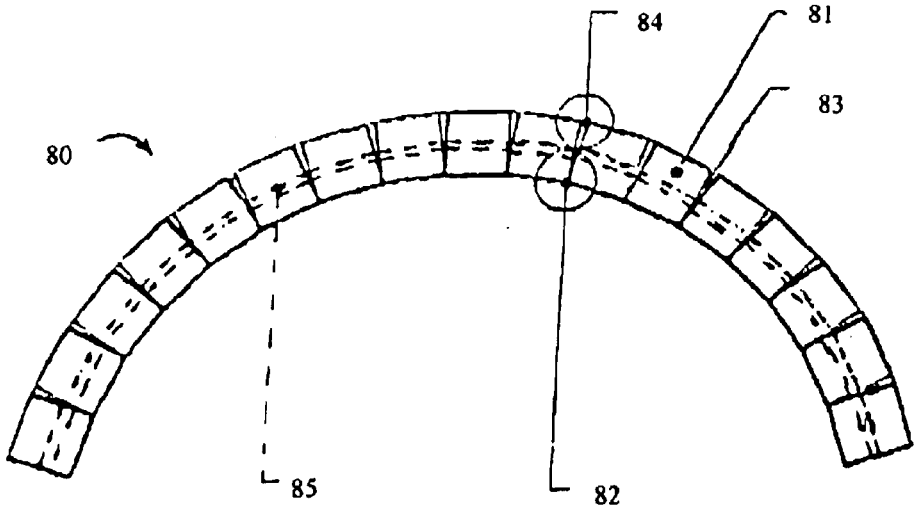
FIG. 8 shows parallelepiped blocks preformed and constructed into an arch.

FIG. 8 shows an arch 80 formed from standard rectangular parallelepiped arch blocks 81 that have essentially parallel sides. The shape facilitates the mass production of blocks that can use low quality but acceptable materials. The inward and lower edges of the blocks are in frictional contact with each other at their intrados 82 with the sides tapering away from each other toward their extrados 83 so that the blocks collectively form an arc or arch 80. The arch blocks abut each other along their inner sides 82 but there may be gaps remaining between the blocks along their outer sides 83. To hold the blocks in position mortar or concrete 84, with or without shock absorbing material, is used to fill the wedge shaped openings between the upper or outer areas between the blocks. The outer gaps can be filled with thin, wedge-shaped energy absorbing material and mortar to prevent the distance and spacing between the blocks from changing. A prestress means 85 can be provided.

An arch can be formed from blocks that have sides that essentially radiate from the central point about which the arch extends. The sides of the blocks are essentially frictionally in contact with each other along the entire length of their sides.

Figure 9:
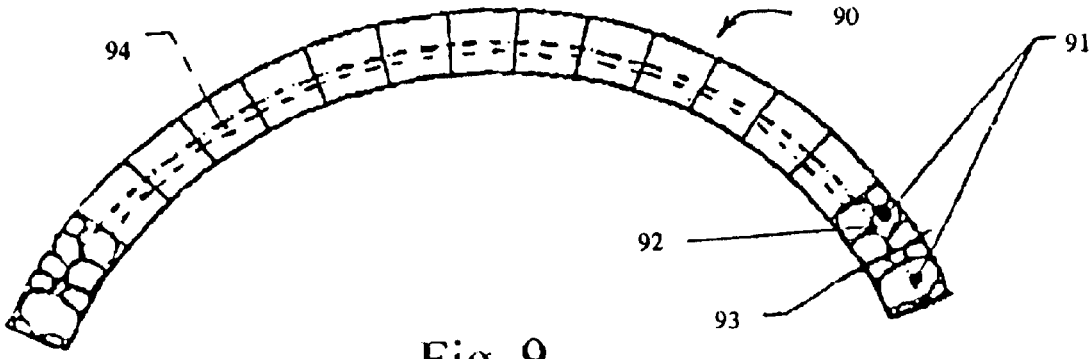
FIG. 9 depicts an arch side view forming the blocks in place.

An arch 90 can be formed on a suppporting structure, such as shown in FIG. 9. A base for the arch can be formed by use of molds. After the mold is formed pieces of stone or aggregate such as ballast, broken stories and/or other coarse aggregate 91 are prepacked in an abutting relationship with the molds and each other. The low quality materials are assembled within the mold so as to be in firm contact with one another. Mortar 92 is then poured into the mold to hold the aggregate in place and to form the base for the block. This technique allows the various low quality materials, such as recycled materials and chipped stones, to be used as the prepacked materials with the mortar used only to keep the aggregate in position. No mixing of coarse aggregate and mortar is required so there is no additional concrete plant expenses for cleaning, new processing steps, and installation.

For forming the next course or adjacent area, the mold can be moved to an adjacent location or other area, or another mold can be used. For this next layer, aggregate is placed in the mold and assembled, then, as before, mortar is poured in with the upper surface shape monitored or controlled to prevent a smooth surface. This process is repeated on both sides of the arch support to provide a base for raising the arch along the predetermined course. The roughened sides 93 frictionally engage each other. The keystone is formed in a similar manner to complete the arch. A prestress means 94 can be provided.

Figure 7:
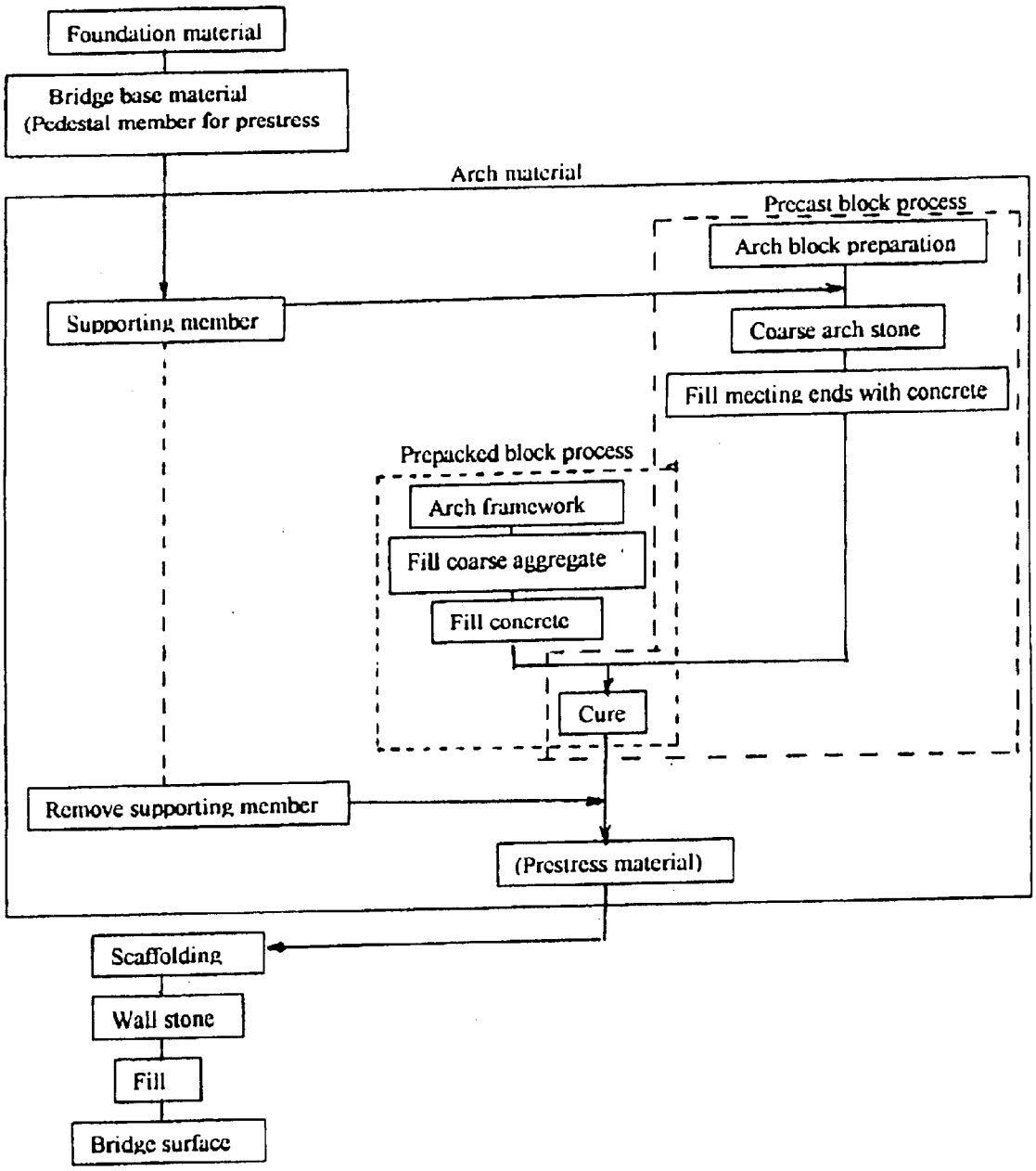
FIG. 7 shows a construction job-flow chart.

The alternate stone arrangement is shown in the job flow chart of FIG. 7. The detail of a traditional technique is published in a report referencing the transfer and restoration of the Nishida Bridge.

The procedures used in the present invention are not limited to the construction of arch-shaped structures but can be used to constrain movement of various type structures during earthquakes to make the structures earthquake resistant.

The forces applied to the arch blocks toward the arch axis is relatively small compared to the force they can tolerate. The lateral expansion is also small. The resistance offered by these materials provides sufficient safety factors. In order to give more freedom in designing structures using low strength materials, tension members, such as iron or steel, are radially inserted along the arch radius to increase the resistance to expansion of the arch. Anchor bolts such as those used in the Natom Tunnel can be used, or rods can be provided, to prevent lateral expansion or movement.

Stability can also be obtained in quasi-constraint continuous material alone, enlarging the size of the blocks or discrete constraint material and mechanically reducing the number of meeting ends depending on the specific application and materials used.

Arch stones are subject to compression force directed in the axial direction and to slight forces in the direction orthogonal to it. Their unit stress is small and arch stones made of low quality rigid material, such as recycled material, basically last for several thousands of years. To take the full benefit of constraint discrete arch technique, it is necessary to understand how to deal with it and repair it. However, neither materials nor loads are uniform and accordingly damages occur locally. Unlike the general continuous material, discontinuous material used by the technique of the present invention allows for the local repair of damaged parts over the space of tens to hundreds of years. Unless the arch is extremely deformed, concrete can be used externally to fill and repair the damaged arch stones as is done in Europe and China. When the arch is so deformed that unit stress is not well propagated, a supporting member must be provided and the damaged arch stones removed. Then, the damaged stones are replaced or rearranged into the correct position. Almost all stone materials can be recycled, and when recycled they last almost indefinitely.

The blocks or discrete construction material can be provided with stress members by inserting tubes, such as PVC tubes, in the mold to embed them at appropriate intervals within the block to provide passages for the insertion of stress members. The members can be prestressed. Prestressed members provide resistance against displacements and a strong restoring force if displacements do occur. It also provides a restoration force during earthquakes. The conventional post tension technique can be used to prestress the member.

Figure 10:
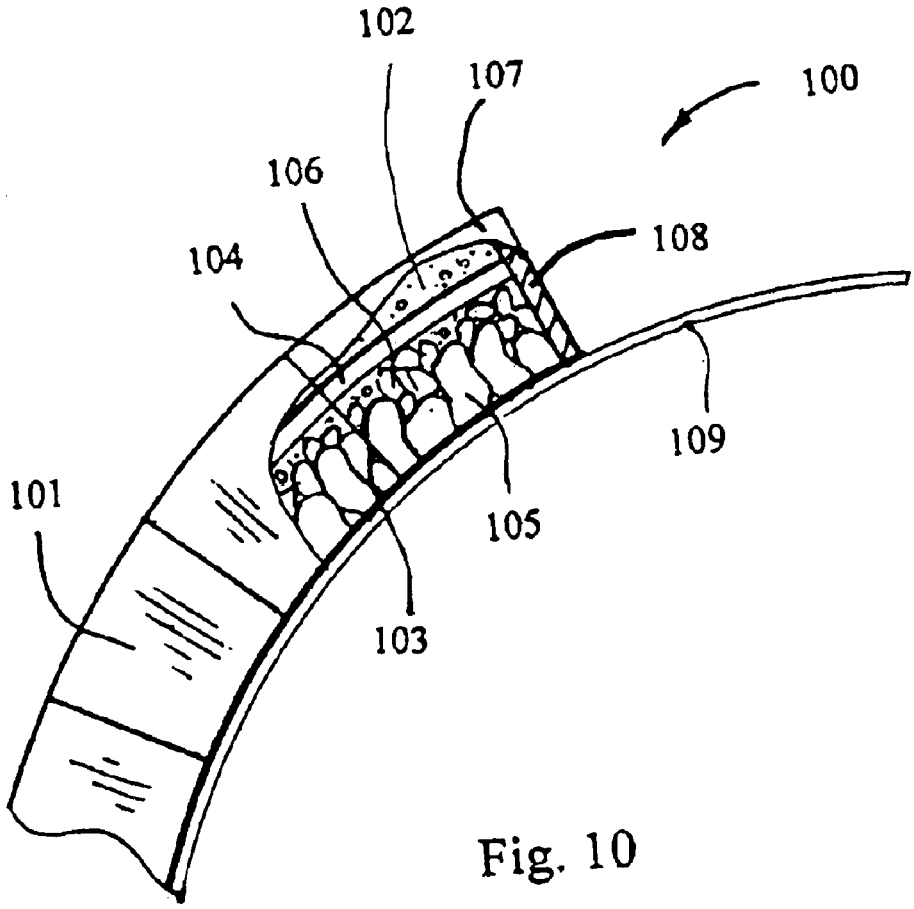
FIG. 10 is a side view of an arch under construction with a portion broken away.

FIG. 10 shows the arch 100 construction essentially as diagramed in FIG. 7 and described in relation thereto. After one block 101 is formed and the mortar cured, the mold 107 is removed from the formed block and placed on the temporary support 109 adjacent to the finished block rough end 103 with the mold 107 and mold end 108 forming an enclosure into which coarse aggregate 105 is placed and positioned in firm contact with each other and the mold sides and mold end and previously formed block rough end 103. Medium or finer aggregate 106 is then placed over and between the coarse aggregate and tubes 104 are positioned within the mold after which mortar 102 is poured into the mold to hold the aggregate and tubes in place.

The technique according to the present invention enables the use of low quality materials that are usually disposed of. Such use yields load bearing, endurance, earthquake-resistance, economical construction, allows recycling, reduces resource depletion, and contributes to environmental preservation. For stone bridges, the following major effects and characteristics are noted:

(1) Besides concrete, which is generally used as a construction material, slag and concrete waste will be made useful, contributing to current and future resource availability and environmental benefits.

(2) Arch bridges present proportion and texture that matches natural scenery that is well received. It is possible to provide specific materials for outer walls that have a specific design or appearance.

(3) Structural safety and unit stress of stone material can be examined for load bearing, endurance, and earthquake-resistant properties using individual factor analysis. Prestress can be applied according to the design conditions, external forces, arch thickness, and so on, to adjust the shape and stress.

(4) Construction, maintenance and life expectancy costs can be lowered by carefully selecting arch material.

(5) Advanced foundation techniques can be used so that horizontally propagated force through the foundation is absorbed by oblique piles.

(6) Unlike traditional techniques that are highly dependent on the skill of stonemasons, modern, sound design and practice are applicable. Advanced construction technology can be applied including advanced analysis systems such as individual factor analysis.

(7) A ratio of span to rise of 16:1 was applied in the Numour Bridge, France. Flat shape and span is ensured for stone bridges. A 120 m span was constructed using advanced design and construction technology and open spandrels (Chosuko Bridge, China).

Rigid bodies usually obtain their stability by being constrained spatially at four points. For arches, at least three points at intersecting ends of the arch axis are necessary. More stability can be obtained when these three points are at a distance from each other.

Stability is obtained by having the ends of the individual blocks of uniform size that precisely abut along the intradose and relieving the middle areas to provide three point constraint. Stability conditions for rigid bodies have problems added to them when elastic bodies are included. When this occurs, the coefficient of elasticity must be included. If an arch is constructed on soil, the shape of the arch can be affected by deformation of the material. When this happens, the anticipated arch effect must take into consideration the elasticity in determining the size of the arch, the load, and the applications.

In addition to the conditions for rigid bodies, resilient plastic coefficients should be considered for stability when using resilient plastic material. For instance, the arch effect can not be expected to suffice for an arch made of soil when its shape is distorted due to the material deformation due to insufficient strength.

The resiliency required is determined by the arch size and load-bearing capability. This means arch size can be selected according to the specific application and materials used.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. An earthquake resistant structure comprising:

a construction block having an upper surface and a lower surface and sides surfaces;

aggregate pieces within said block lower extent adjacent to said lower surface and forming the major extent of said lower surface;

said aggregate pieces each having a circumference in excess of 5 cm and being in direct firm contact with one another;

said aggregate pieces extending from and between said construction block sides;

said aggregate pieces held in contact with each other by mortar above said aggregate pieces so that said construction block provides a strong support for vertical forces applied to said upper surface and a strong resistance to horizontal vibrations of an earthquake applied to said side surfaces by transfer forces directly from one aggregate piece to another throughout said construction block lower extent.

2. An earthquake resistant structure as in claim 1 wherein:

a plurality of said construction blocks is placed adjacent to one another such that said aggregate pieces at one surface of one said block are in direct contact with said aggregate pieces of another adjacent said block such that forces on one block are transferred through said aggregate materials from one said block to another adjacent said block.

3. An earthquake resistant structure as in claim 1 wherein:

said construction block is formed in the shape of a parallelepiped;

a plurality of said blocks is placed side by side adjacent to one another in the shape of an arch with said aggregate pieces of one said construction block contacting aggregate pieces in an adjacent said construction block.

4. An earthquake resistant structure as in claim 3 wherein:

said parallelepiped blocks placed in the form of an arch have their intrados ends abutting each other and their extrados ends spaced from each other;

concrete is within a space between said blocks extrados ends.

5. An earthquake resistant structure as in claim 1 wherein:

said construction block is formed in the shape of a tetrahedron with two essentially triangular sides and two parallel sides;

a plurality of said construction blocks is placed adjacent to one another such that said aggregate pieces on adjacent surfaces of one block are in direct contact with aggregate pieces of said adjacent block such that forces on one block are transferred directly through said aggregate pieces of one said block to said aggregate pieces of said adjacent block along their contacting surface.

6. An earthquake resistant structure as in claim 1 wherein:

said aggregate material consists of a coarse aggregate material having a circumference in excess of 20 cm. and a fine aggregate material having a circumference between 5 and 20 cm. in intimate contact with each other throughout said block.

7. An earthquake resistant structure as in claim 1 wherein:

said block has a tube therein extending from one said side to another said side for accommodating a prestress means.

8. An earthquake resistant structure as in claim 1 wherein:

said aggregate pieces are of a low quality material.

9. An earthquake resistant structure as in claim 8 wherein:

said aggregate pieces are slag.

10. An earthquake resistant structure as in claim 8 wherein:

said aggregate pieces are crushed stone.

11. An earthquake resistant structure as in claim 8 wherein:

said aggregate pieces are concrete chips.

12. An earthquake resistant structure as in claim 8 wherein:

said aggregate pieces are Sirasu.

13. A process for forming construction blocks to resist earthquakes comprising:

providing a mold having an upper extent and a lower extent in the desired shape of a construction block;

placing aggregate pieces having a circumference in excess of 5 cm. within said mold lower extent;

positioning said aggregate pieces within said mold lower extent so that said aggregate pieces are in firm contact with said mold sides and in firm contact with each other throughout said mold to form a lower surface;

pouring mortar over said positioned aggregate pieces so as to maintain their position and form an upper surface and form a block having a strong resistance to vertical forces applied to said upper surface and a resistance to horizontal vibrations of an earthquake by transferring forces applied directly from one aggregate piece to another;

removing said block from said mold.

14. A process for forming construction blocks as in claim 13 including:

forming said block in the shape of a parallelepiped;

placing a plurality of said blocks in side by side contacting relationship such that said aggregate pieces in one block contacts said aggregate pieces in an adjacent block so that horizontal force applied to one said block is transferred directly from said aggregate pieces in said one block to said aggregate pieces in said adjacent block.

15. A process for forming construction blocks as in claim 14 including:

forming said blocks into the shape of an arch such that said blocks abut each other at their intrados ends and are spaced from each other at their extrados ends;

filling a space at said extrados ends with concrete to hold said blocks in place.

16. A process for forming construction blocks as in claim 13 including:

forming a support structure in the shape of an arch;

placing said mold on one end of said support structure;

forming said block in place on said support structure;

curing said mortar on said supporting structure;

removing said mold and using it to form another said block adjacent to said previously formed block to manufacture said blocks adjacent to one another with said aggregate pieces of one said block in contact with said aggregate pieces of an adjacent said block.

17. A process for forming construction blocks as in claim 13 including:

placing a tube within said mold with said aggregate pieces to provide a conduit for a prestress means within said block.

18. A process for forming construction blocks as in claim 13 including:

said aggregate pieces including both coarse aggregate pieces in excess of 25 cm. circumference and fine aggregate pieces between 5 cm. and 15 cm. circumference;

placing both said coarse aggregate pieces and said fine aggregate pieces within said mold such that said fine aggregate pieces fit between spaces between said coarse aggregate pieces and such that said fine aggregate pieces and said coarse aggregate pieces are in intimate contact with each other.

19. A process for forming construction blocks as in claim 13 including:

selecting said aggregate pieces from a low quality material.

* * * * *